US008414984B2

(12) United States Patent
Hoshina et al.

(10) Patent No.: US 8,414,984 B2
(45) Date of Patent: Apr. 9, 2013

(54) POWDER FOR MAGNETIC CORE, METHOD FOR MANUFACTURING POWDER FOR MAGNETIC CORE, AND DUST CORE

(75) Inventors: Eisuke Hoshina, Toyota (JP); Toshiya Yamaguchi, Miyoshi (JP); Yusuke Oishi, Nagoya (JP); Tomoyasu Kitano, Nisshin (JP); Kazuhiro Kawashima, Kasugai (JP); Junghwan Hwang, Nisshin (JP)

(73) Assignees: Toyota Jidosha Kabushiki Kaisha, Toyota-shi (JP); Fine Sinter Co., Ltd., Kasugai-shi (JP)

( * ) Notice: Subject to any disclaimer, the term of this patent is extended or adjusted under 35 U.S.C. 154(b) by 0 days.

(21) Appl. No.: 12/742,507

(22) PCT Filed: Nov. 11, 2008

(86) PCT No.: PCT/IB2008/003399

§ 371 (c)(1),
(2), (4) Date: Jun. 17, 2010

(87) PCT Pub. No.: WO2009/063316

PCT Pub. Date: May 22, 2009

(65) Prior Publication Data

US 2010/0271158 A1 Oct. 28, 2010

(30) Foreign Application Priority Data

Nov. 12, 2007 (JP) ..... 2007-293424

(51) Int. Cl.
*B05D 5/00* (2006.01)

(52) U.S. Cl.
USPC ..... 427/550; 428/403

(58) Field of Classification Search ..... 428/403, 428/570, 297; 427/212, 203, 199, 191, 550
See application file for complete search history.

(56) References Cited

U.S. PATENT DOCUMENTS

| | | | | |
|---|---|---|---|---|
| 2005/0133116 | A1 | 6/2005 | Nishijima et al. | |
| 2007/0221297 | A1 * | 9/2007 | Matsukawa et al. | 148/307 |

FOREIGN PATENT DOCUMENTS

| | | | |
|---|---|---|---|
| JP | 47-14682 | B | 5/1972 |
| JP | 49-74133 | A | 7/1974 |
| JP | 63271905 | * | 11/1988 |
| JP | 02-011701 | A | 1/1990 |
| JP | 0211701 | * | 1/1990 |
| JP | 02-097603 | * | 4/1990 |
| JP | 3-138350 | A | 6/1991 |

(Continued)

OTHER PUBLICATIONS

Office Action issued Aug. 25, 2011 in CN Application No. 200880115797.2 and English translation thereof.

*Primary Examiner* — Michael Cleveland
*Assistant Examiner* — Tabassom Tadayyon Eslami
(74) *Attorney, Agent, or Firm* — Kenyon & Kenyon LLP

(57) ABSTRACT

A method for manufacturing a powder for a magnetic core including at least a process of performing a siliconizing treatment on a surface of an iron powder containing elemental carbon. In the process of siliconizing treatment, a powder containing at least a silicon dioxide is brought into contact with the surface of the iron powder, elemental silicon is detached from the silicon dioxide by heating the powder of silicon dioxide, and the siliconizing treatment is performed by causing the detached elemental silicon to permeate and diffuse into a surface layer of the iron powder. The invention provides a method for manufacturing a powder for a magnetic core, by which loss reduction is achieved.

13 Claims, 5 Drawing Sheets

FOREIGN PATENT DOCUMENTS

| | | | | |
|---|---|---|---|---|
| JP | 09-180924 | A | | 7/1997 |
| JP | 410189323 | | * | 7/1998 |
| JP | 11-087123 | A | | 3/1999 |
| JP | 2003-332116 | A | | 11/2003 |
| JP | 2005-146315 | A | | 6/2005 |
| JP | 2005-154791 | | * | 6/2005 |
| JP | 2007-113094 | A | | 5/2007 |
| JP | 2007-126696 | A | | 5/2007 |
| JP | 2007-146254 | A | | 6/2007 |
| JP | 2007-214366 | A | | 8/2007 |

* cited by examiner

POWDER FOR MAGNETIC CORE, METHOD FOR MANUFACTURING POWDER FOR MAGNETIC CORE, AND DUST CORE

This is a 371 national phase application of PCT/IB2008/003399 filed 11 Nov. 2008, claiming priority to Japanese Patent Application No. 2007-293424 filed 12 Nov. 2007, the contents of which are incorporated herein by reference.

BACKGROUND OF THE INVENTION

1. Field of the Invention

The invention relates to a powder for a magnetic core using a soft magnetic powder, a method for manufacturing the powder for a magnetic core, and a dust core, and more particularly to a powder for a magnetic core obtained by subjecting the surface of a soft magnetic powder to siliconizing.

2. Description of the Related Art

A dust core (powder molded body) can be manufactured by compacting and molding a powder for a magnetic core. An important feature of the dust core is that magnetic properties corresponding to applications are ensured, while ensuring electric insulation between soft magnetic particles constituting the powder for a magnetic core. Accordingly, a large number of dust cores have been researched and developed.

For example, when an iron-based soft magnetic powder (iron powder) of pure iron is used as a soft magnetic powder, a dust core with the highest magnetic flux density can be obtained. This is because the pure iron includes no impurities and, therefore, the iron powder is soft and a dust core of a high density can be easily compression molded from the iron powder.

However, because pure iron has a low specific resistance, when a soft magnetic powder of pure iron is compression molded, an eddy current loss of the dust core increases. A method for manufacturing a powder for a magnetic core by adding elemental silicon or elemental aluminum to the pure iron with the object of increasing the resistance inside the iron powder is one of the methods for reducing the eddy current. However, when these elements are added to pure iron, the hardness of iron increases, thereby increasing hardness of the iron powder itself. As a result, the density of the dust core is difficult to increase.

Accordingly, the surface of pure iron powder is sometimes subjected to phosphating, or coated with a resin such as an epoxy resin or a silicone resin. For example, a phosphate coating film formed on the surface of iron powder by phosphating has a small thickness. Therefore, a high-density dust core can be molded, without losing the properties of the pure iron. However, the dust core obtained by compression molding is sometimes annealed to remove strains introduced during compaction molding, and when the annealing temperature exceeds 500° C., the phosphate diffuses in the iron, thereby making it impossible to increase further the annealing temperature. As a result, strains present in the dust core cannot be sufficiently released and hysteresis loss of the dust core can increase.

In the case of coating with a silicone resin, the silicone resin is more stable at a high temperature than phosphates and has higher heat resistance. However, when a pure iron powder is coated with a silicone resin, the silicone resin film is difficult to preserve during compression molding. Furthermore, because the annealing temperature is raised to about 600° C., a thick silicone resin film has to be coated. As a result, the density of the iron powder for a dust core decreases with the increase in the film density, and the magnetic flux density of the dust core decreases.

A large number of attempts have been made to siliconize (silicide) the iron surface with the object of enriching it with silicon. The siliconizing treatment is typically performed by chemical vapor deposition (CVD) using a silicon tetrachloride gas as a treatment gas.

Accordingly, the possibility of improving magnetic properties by siliconizing has attracted attention and, for example, a method for manufacturing a powder for a magnetic core by performing siliconizing by CVD of a soft magnetic powder under a heating atmosphere of a silicon tetrachloride gas and argon has been suggested (for example, Japanese Patent Application Publication No. 11-87123 (JP-A-11-87123)). With this manufacturing method, increasing the concentration of elemental silicon in the surface of a soft magnetic powder increases magnetic permeability of a dust core and improves magnetic characteristics in a high-frequency range.

However, when the manufacturing method described in JP-A-11-87123 is employed, because a hazardous silicon tetrachloride gas is used, a special manufacturing apparatus designed with consideration for safety has to be used in the manufacturing method. As a result, the production cost in the manufacture of the powder for a magnetic core increases over that in other methods.

SUMMARY OF THE INVENTION

The invention provides a powder for a magnetic core that can be manufactured safely and at a low cost, in which elemental silicon is introduced at a high content ratio in the vicinity of an iron powder surface, and a loss (iron loss) of the dust core can be reduced, and also to a method for manufacturing such a powder, and a dust core.

The results of the comprehensive study conducted by the inventors demonstrated that when a chemical reaction such that generates the elemental silicon alone is induced at the surface of a soft magnetic powder, the generated elemental silicon permeates from the surface into the soft magnetic powder and mainly diffuses into the surface layer thereof.

The invention is based on this information. A method for manufacturing a powder for a magnetic core according to a first aspect of the invention is a method for manufacturing a powder for a magnetic core including at least a process of performing a siliconizing treatment on a surface of a soft magnetic powder, wherein the siliconizing treatment process includes bringing a powder for siliconizing that contains at least a silicon compound into contact with the surface of the soft magnetic powder, detaching elemental silicon from the silicon compound by heating the powder for siliconizing, and performing the siliconizing treatment by causing the detached elemental silicon to permeate and diffuse into a surface layer of the soft magnetic powder.

According to the first aspect of the invention, elemental silicon is detached (generated) from a silicon compound at a surface (more specifically, at a contact surface with a powder for siliconizing) of a soft magnetic powder. Therefore, the elemental silicon is present at an atomic level on the surface of the soft magnetic powder. As a result, the elemental silicon can be introduced in the surface layer in the vicinity of the surface at a concentration higher than that inside the soft magnetic powder. Further, the content of elemental silicon introduced in the soft magnetic powder can be adjusted by appropriately adjusting the generated amount of the elemental silicon.

The expression "detaching elemental silicon from a silicon compound" as used in the description of the invention means generating elemental silicon from a powder for siliconizing by chemically inducing a reaction of the silicon compound contained in the powder for siliconizing. More specifically, the following methods can be used therefor: a method of inducing an oxidation-reduction reaction of components of a soft magnetic powder and a powder for siliconizing and generating elemental silicon by heating the powder for siliconizing, a method of causing a flow of a treatment gas at a contact surface of a soft magnetic powder and a powder for siliconizing, inducing an oxidation-reduction reaction of the treatment gas and the powder for siliconizing at least at the contact surface, and generating elemental silicon, and a method of inducing a self-decomposition reaction of a powder for siliconizing that has been added to and mixed with a soft magnetic powder and generating elemental silicon by heating the powder for siliconizing. Further, the expression "causing the detached elemental silicon to permeate and diffuse into a surface layer of the soft magnetic powder" as used in the description of the invention means causing the elemental silicon to permeate from the surface of a soft magnetic powder and causing at least the elemental silicon that has permeated into the surface layer to diffuse.

When elemental silicon is generated, a gas (for example, a carbon monoxide gas and the like) is generated as a byproduct. As the siliconizing treatment advances, the increase in the gas concentration inhibits the reaction of elemental silicon generation. Accordingly, in the method for manufacturing a powder for a magnetic core according to the first aspect of the invention, the treatment gas or inactive gas may be circulated (under an atmosphere with a low gas concentration (for example, in the case of a carbon monoxide gas, under an atmosphere with a low concentration of carbon monoxide (CO))) or the generated gas may be discharged so that the gas concentration does not increase at the surface of the soft magnetic powder that is in contact with the powder for siliconizing.

Examples of the inactive gas include rare gases such as argon gas and hydrogen ($H_2$), and a gas that does not impede the reaction of elemental silicon generation may be circulated. When an iron-based powder is used for the soft magnetic powder, the heating temperature in the detachment of the elemental silicon is preferably equal to or less than 1180° C. This is because when the heating temperature is higher than 1180° C., a liquid phase appears in the iron-based powder into which the elemental silicon has permeated.

The method for manufacturing a powder for a magnetic core according to the first aspect of the invention may further include a process of performing a gradual oxidation treatment on the soft magnetic powder after the siliconizing treatment. With the first aspect of the invention, by performing the gradual oxidation treatment, it is possible to oxidize only the elemental silicon contained in the soft magnetic powder and to generate silicon dioxide ($SiO_2$) in the surface layer including the surface of the soft magnetic powder. As a result, a layer including silicon dioxide ($SiO_2$) and using the soft magnetic powder as the base material can be formed on the surface layer of the powder for a magnetic core. A dense insulating layer of silicon dioxide ($SiO_2$) can thus be formed, a dust core of a high density can be manufactured, and magnetic properties of the dust core can be improved.

The expression "gradual oxidizing treatment" as used in the description of the invention means a treatment by which the soft magnetic powder after the siliconizing treatment is disposed under an oxygen atmosphere with an oxygen concentration (partial pressure of oxygen) appropriately lower than the air atmosphere, more specifically, under an atmosphere in which a very small amount of water vapor is contained in an inactive gas or the like, and only the elemental silicon is oxidized by heating under such atmosphere. The oxygen concentration (amount of water vapor) is appropriately set according to the material of the powder for a magnetic core and concentration of elemental silicon.

In the method for manufacturing a powder for a magnetic core according to the first aspect of the invention, the powder for siliconizing may be a very fine powder in order to conduct the reaction of detaching (generating) the elemental silicon with good efficiency. In particular, a mean particle size may be equal to or less than 1 μm. With consideration for the production cost and the like, a mean particle size of the powder for siliconizing may be equal or more than 20 nm. Further, when the mean particle size of the powder for siliconizing is more than 1 μm, the reaction of elemental silicon generation tends to proceed slowly.

In the method for manufacturing a powder for a magnetic core according to the first aspect of the invention, an iron-based powder may be used as the soft magnetic powder, and the siliconizing treatment may be performed together with an annealing treatment of the magnetic powder. As a result, coarsening of crystal grains of the soft magnetic powder can be performed at the same time by performing the heating involved in the siliconizing treatment under the heating conditions of the annealing treatment, and hysteresis loss of the dust core obtained by compression molding the powder for a magnetic core can be reduced.

In the method for manufacturing a powder for a magnetic core according to the first aspect of the invention, an iron-based powder containing at least elemental carbon may be used as the soft magnetic powder, and a powder containing at least silicon dioxide ($SiO_2$) may be used as the powder for siliconizing.

In this case, elemental silicon is detached (generated) from silicon dioxide ($SiO_2$) and carbon monoxide gas is generated by an oxidation-reduction reaction of the carbon (C) contained in the iron-based powder and silicon dioxide ($SiO_2$), which is a silicon compound. As a result, the detached elemental silicon permeates from the surface of the iron-based powder and diffuses mainly into a surface layer of the iron-based powder. On the other hand, elemental carbon present on the surface of the iron-based powder becomes a carbon monoxide gas, the elemental carbon present inside the iron-based powder diffuses toward the surface, and the diffused carbon also becomes a carbon monoxide gas due to the aforementioned reaction. As a result, when elemental carbon is contained as an impurity in the soft magnetic powder, the content of the elemental carbon can be decreased and purity of the iron-based powder can be increased. Furthermore, where the content of elemental carbon is adjusted in advance by performing, for example, carburizing treatment of the soft magnetic powder, the content of elemental silicon can be adjusted by a combination of this adjustment with the aforementioned reaction. Further, where heating is performed under an atmosphere with a low concentration of carbon monoxide (CO) under an atmospheric pressure or a lower pressure, the reaction can be initiated and the siliconizing treatment process can be conducted easily and at a low cost. Further, the "low carbon monoxide concentration" as referred to herein is a concentration of carbon monoxide gas at which the aforementioned oxidation-reduction reaction can develop (siliconizing treatment is possible), and the concentration of carbon monoxide gas may be decreased to induce this reaction more reliably.

In the method for manufacturing a powder for a magnetic core according to the first aspect of the invention, an iron-based powder containing at least elemental oxygen is used as the soft magnetic powder, and a powder containing at least silicon carbide (SiC) is used as the powder for siliconizing.

In this case, elemental silicon is detached (generated) from silicon carbide (SiC) and carbon monoxide gas is generated by an oxidation-reduction reaction of oxygen (O) contained in the iron-based powder and silicon carbide (SiC), which is a silicon compound. As a result, the detached elemental silicon permeates from the surface of the iron-based powder and diffuses mainly into a surface layer of the iron-based powder, in the same manner as described hereinabove. On the other hand, elemental oxygen contained in the surface of the iron-based powder becomes a carbon monoxide gas, the elemental oxygen present inside the iron-based powder diffuses toward the surface, and the diffused oxygen also becomes a carbon monoxide gas via the aforementioned reaction. As a result, when elemental oxygen is contained as an impurity in the soft magnetic powder, the content of the elemental oxygen can be decreased and purity of the iron-based powder can be increased in the same manner as described hereinabove. Furthermore, where the content of elemental oxygen is adjusted in advance by performing, for example, oxidation treatment of the soft magnetic powder (such as heating under an oxygen atmosphere), the content of elemental silicon can be adjusted by a combination of this adjustment with the aforementioned reaction. Further, where heating is performed under an atmosphere with a low concentration of carbon monoxide (CO) under an atmospheric pressure or a lower pressure, the reaction can be initiated and the siliconizing treatment process can be conducted easily and at a low cost.

In the method for manufacturing a powder for a magnetic core according to the first aspect of the invention, a mixed powder obtained by mixing at least a powder of silicon dioxide ($SiO_2$) and a powder of silicon carbide (SiC) may be used as the powder for siliconizing. In this case, elemental silicon is detached (generated) from both the silicon dioxide ($SiO_2$) and the silicon carbide (SiC) and carbon monoxide gas is generated by an oxidation-reduction reaction of the silicon dioxide ($SiO_2$) and the silicon carbide (SiC), which are silicon compounds. As a result, the detached elemental silicon permeates from the surface of the iron-based powder and diffuses mainly into a surface layer of the iron-based powder, in the same manner as described hereinabove. Further, where heating is performed under an atmosphere with a low concentration of carbon monoxide (CO) under an atmospheric pressure or a lower pressure, the reaction can be initiated and the siliconizing treatment process can be conducted easily and at a low cost. Further, by adjusting the amount of powder containing silicon dioxide ($SiO_2$) and the amount of silicon carbide powder, it is possible to adjust the amount of elemental silicon that is caused to permeate into the soft magnetic powder, regardless of the content of carbon (C) and content of oxygen (O) in the soft magnetic powder.

In the method for manufacturing a powder for a magnetic core according to the first aspect of the invention, a mixed powder obtained by mixing a powder containing at least silicon dioxide ($SiO_2$) and a powder containing either or both of a metal carbide and a carbon allotrope may be used as the powder for siliconizing.

In this case, elemental silicon is detached (generated) from the silicon dioxide ($SiO_2$) and carbon monoxide gas is generated by an oxidation-reduction reaction of the silicon dioxide ($SiO_2$), which is a silicon compound, and the metal carbide or carbon allotrope. As a result, the detached elemental silicon permeates from the surface of the iron-based powder and diffuses mainly into a surface layer of the iron-based powder, in the same manner as described hereinabove. Further, where heating is performed under an atmosphere with a low concentration of carbon monoxide under an atmospheric pressure or a lower pressure, the reaction can be initiated and the siliconizing treatment process can be conducted easily and at a low cost. Further, by adjusting the amount of powder including silicon dioxide ($SiO_2$) and the amount of carbon-containing powder, it is possible to adjust the amount of elemental silicon that is caused to permeate into the soft magnetic powder. Furthermore, when a powder containing a metal carbide is used, because the metal element is detached from the metal carbide, the metal element can be also caused to permeate into the soft magnetic powder.

Examples of the metal carbide include titanium carbide (TiC) and tungsten carbide (WC). The metal carbide is not particularly limited, provided that an insulating oxide can be formed by the gradual oxidation treatment and that the metal element produces no adverse effect on magnetic properties. A specific metal that is wished to be caused to permeate into the soft magnetic powder may be selected according to the usage characteristics of the powder for a magnetic core. Examples of the carbon allotrope include carbon (C), graphite, diamond like carbon (DLC), and diamond. The carbon allotrope is not particularly limited, provided that it has carbon (C) as the main component.

In the method for manufacturing a powder for a magnetic core according to the first aspect of the invention, a mixed powder obtained by mixing a powder containing at least silicon carbide (SiC) and a powder of at least one kind from among powders composed of metal oxides may be used as the powder for siliconizing.

In this case, elemental silicon is detached (generated) from the silicon carbide (SiC) and carbon monoxide gas is generated by an oxidation-reduction reaction of the silicon carbide (SiC), which is a silicon compound, and a powder of at least one kind from among powders composed of metal oxides. As a result, the detached elemental silicon permeates from the surface of the iron-based powder and diffuses mainly into a surface layer of the iron-based powder, in the same manner as described hereinabove. Further, where heating is performed under an atmosphere with a low concentration of carbon monoxide (CO) under an atmospheric pressure or a lower pressure, the reaction can be initiated and the siliconizing treatment process can be conducted easily. Further, by adjusting the amount of powder containing silicon carbide (sic) and the amount of powder containing a metal oxide, it is possible to adjust the amount of elemental silicon that is caused to permeate into the soft magnetic powder. Furthermore, when a powder containing a metal oxide is used, because the metal element is detached from the metal oxide, the metal element can be also caused to permeate into the soft magnetic powder.

Examples of the metal oxide include aluminum oxide ($Al_2O_3$), titanium oxide ($TiO_2$), magnesium oxide (MgO), and sodium borate ($Na_2B_4O_7$). The metal oxide is not particularly limited, provided that an insulating oxide can be formed by the gradual oxidation treatment and that the metal element produces no adverse effect on magnetic properties. A specific metal that is wished to be caused to permeate into the soft magnetic powder may be selected according to the usage characteristics of the powder for a magnetic core.

In the method for manufacturing a powder for a magnetic core according to the first aspect of the invention, a powder containing at least silicon dioxide ($SiO_2$) is used as the powder for siliconizing, and the siliconizing treatment is performed under a hydrocarbon gas atmosphere.

In this case, elemental silicon is detached (generated) from the silicon dioxide ($SiO_2$) and carbon monoxide gas is generated by an oxidation-reduction reaction of elemental carbon of the hydrocarbon gas and the silicon dioxide ($SiO_2$), which is a silicon compound, at the surface of the soft magnetic powder where the soft magnetic powder is in contact with the powder for siliconizing and in the vicinity thereof. As a result, the detached elemental silicon permeates from the surface of the iron-based powder and diffuses mainly into a surface layer of the iron-based powder. The hydrocarbon gas atmosphere in accordance with the invention is the so-called carburizing atmosphere. Examples of hydrocarbon gases include butane gas, ethane gas, and acetylene gas. The hydrocarbon gas is not particularly limited, provided that the above-described reaction can be induced.

In the method for manufacturing a powder for a magnetic core according to the first aspect of the invention, a powder containing at least silicon carbide (SiC) is used as the powder for siliconizing, and the siliconizing treatment is performed under an oxidizing atmosphere.

In this case, elemental silicon is detached (generated) from the silicon carbide (SiC) and carbon monoxide gas is generated by an oxidation-reduction reaction of elemental oxygen of the gas and the silicon carbide (SiC), which is a silicon compound, under an oxidizing atmosphere such as an ammonia decomposition gas (ammonia decomposition gas with a high dew point) containing water vapor. As a result, the detached elemental silicon permeates from the surface of the iron-based powder and diffuses mainly into a surface layer of the iron-based powder.

In the method for manufacturing a powder for a magnetic core according to the first aspect of the invention, a powder containing silicon nitride may be used as the powder for siliconizing. In this case, elemental silicon is detached (generated) from silicon nitride ($Si_3N_4$) and nitrogen gas ($N_2$) is generated by a decomposition reaction of the silicon nitride ($Si_3N_4$). As a result, the detached elemental silicon permeates from the surface of the iron-based powder and diffuses mainly into a surface layer of the iron-based powder. Further, where heating is performed under an atmosphere with a low concentration of nitrogen under an atmospheric pressure or a lower pressure, the reaction can be initiated and the siliconizing treatment process can be conducted easily. By adjusting the amount of powder containing silicon nitride ($Si_3N_4$), it is possible to adjust the amount of elemental silicon that is caused to permeate into the soft magnetic powder, regardless of the content of carbon (C) and content of oxygen (O) in the soft magnetic powder. Further, the "low nitrogen concentration" as referred to herein is a concentration (nitrogen partial pressure) of low-nitrogen gas ($N_2$) at which the aforementioned decomposition reaction can develop (siliconizing treatment is possible), and the concentration of nitrogen gas ($N_2$) may be decreased to induce the decomposition reaction more reliably.

Among the above-described types of siliconizing treatment, when the treatment is different from that performed under a hydrocarbon gas atmosphere or oxidizing atmosphere, the siliconizing treatment process of the method for manufacturing a powder for a magnetic core in accordance with the invention may be performed under a vacuum atmosphere. In this case, because the treatment is performed under a vacuum atmosphere, carbon monoxide gas or nitrogen gas ($N_2$) generated as a reaction product is also discharged. Therefore, the oxidation-reduction reaction or decomposition reaction proceeding during the siliconizing treatment can be enhanced. Further, the vacuum atmosphere can be achieved by loading the soft magnetic powder and powder for siliconizing into a sealed space suitable for the siliconizing treatment and then evacuating the air from the sealed space with a vacuum pump.

The soft magnetic powder used in the method for manufacturing a powder for a magnetic core according to the first aspect of the invention may be manufactured by a water atomizing method, a gas atomizing method, a reduction method, a grinding method, and the like. The shape of the powder for a magnetic core has to be such as to ensure contact with the powder for siliconizing that has the mean particle size within the above-describe range. Therefore, fine peaks and valleys on the surface of the soft magnetic powder may be low and shallow. A method for bringing the soft magnetic powder and the powder for siliconizing into contact with each other is not particularly limited, provided that the contact with the powder for siliconizing can be ensured. The shape of the soft magnetic powder and powder for siliconizing is not particularly limited and may be spherical, flat, or polygonal.

A second aspect of the invention relates to a powder for a magnetic core that is advantageous for a dust core. The powder for a magnetic core according to the second aspect of the invention is a powder for a magnetic core manufactured by any of the above-described manufacturing methods. This powder for a magnetic core is formed from a soft magnetic powder having a silicon-containing layer containing at least elemental silicon on a surface. In the silicon-containing layer, a concentration of elemental silicon increases gradually from the inside of the powder toward the surface, and at least a silicon-permeated layer into which elemental silicon has permeated is formed in the silicon-containing layer.

According to the second aspect of the invention, a dense layer of silicon dioxide ($SiO_2$) can be obtained by forming the silicon-permeated layer. Further, a dust core obtained by compression molding the powder for a magnetic core according to the second aspect of the invention has magnetic characteristics, including the reduction of eddy current loss, superior to those of the dust core produced using a powder for a magnetic core manufactured by the methods in the related art.

In the silicon-containing layer of the powder for a magnetic core according to the second aspect of the invention, a layer containing silicon dioxide ($SiO_2$) may be further formed so as to surround the silicon-permeated layer. As a result, by forming a layer containing silicon dioxide ($SiO_2$) so as to surround the silicon-permeated layer, it is possible to obtain a powder for a magnetic core with high insulating properties.

A thickness of the layer containing silicon dioxide ($SiO_2$) of the powder for a magnetic core according to the second aspect of the invention may be within a range of 1 nm to 100 nm. As a result, by forming the layer with a thickness within such range, it is possible to obtain a powder for a magnetic core with higher insulating properties. When the thickness is less than 1 nm, insulating properties are degraded, and when the thickness is more than 100 nm, the density of the soft magnetic powder during compression molding can decrease.

A dust core according to a third aspect of the invention is manufactured by compaction molding the powder for a magnetic core according to the second aspect of the invention by disposing the powder in a molding die and pressurizing. The dust core according to the third aspect of the invention has magnetic properties superior to those of the dust core of the related technology.

With the invention, it is possible to cause the permeation of a desired amount of elemental silicon from the surface of a soft magnetic powder and introduce the desired amount of elemental silicon at least into the surface layer of the soft magnetic powder.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein:

FIG. 2A illustrates a siliconizing treatment using silicon dioxide ($SiO_2$) as a powder for siliconizing. FIG. 2B illustrates a siliconizing treatment using silicon carbide (SiC) as a powder for siliconizing.

FIG. 3A illustrates a siliconizing treatment using silicon dioxide ($SiO_2$) and silicon carbide (SiC) as powders for siliconizing. FIG. 3B illustrates a siliconizing treatment using silicon dioxide ($SiO_2$) as a powder for siliconizing and a powder of titanium carbide (TiC), as a modification example of the siliconizing treatment illustrated by FIG. 3A. FIG. 3C illustrates a siliconizing treatment using silicon carbide (SiC) as a powder for siliconizing and a powder of titanium oxide ($TiO_2$), as a modification example of the siliconizing treatment illustrated by FIG. 3A.

FIG. 4A illustrates a siliconizing treatment using silicon dioxide ($SiO_2$) as a powder for siliconizing. FIG. 4B illustrates a siliconizing treatment using silicon carbide (SiC) as a powder for siliconizing, as a modification example of the siliconizing treatment illustrated by FIG. 4A.

FIG. 6A is a photo of an EPMA image of the powder for a magnetic core of Example 1, and FIG. 6B is a photo of an EPMA image of the powder for a magnetic core of Example 2.

DETAILED DESCRIPTION OF EMBODIMENTS

Figure 1:
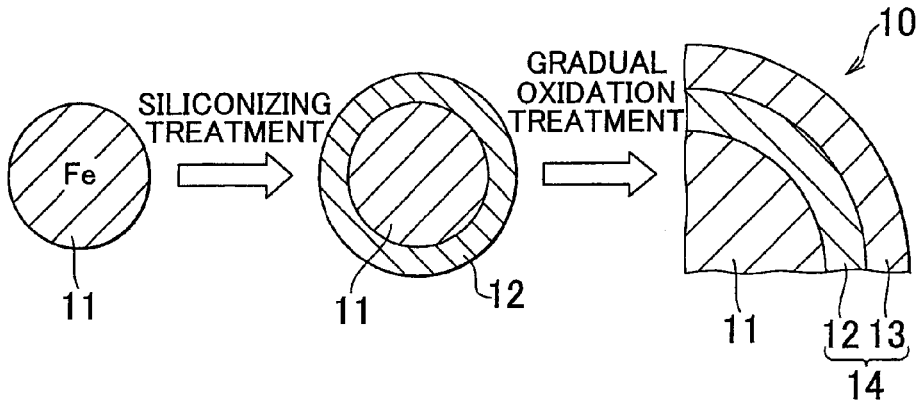
FIG. 1 illustrates a method for advantageously manufacturing the powder for a magnetic core in accordance with the invention.
Figure 2A:
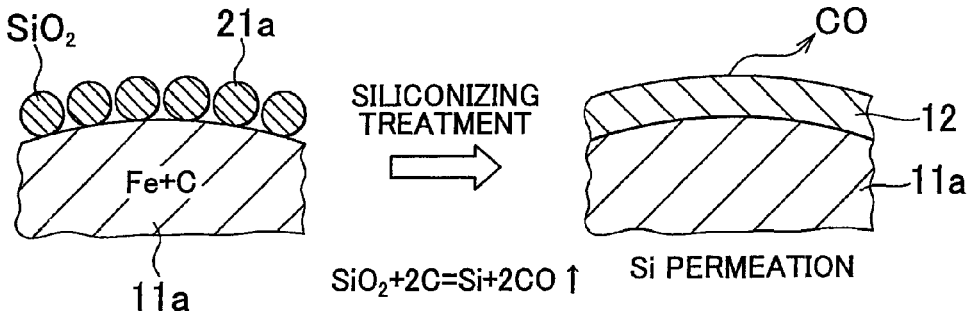
FIGS. 2A and 2B illustrate a method for manufacturing a powder for a magnetic core of a first embodiment.
Figure 2B:
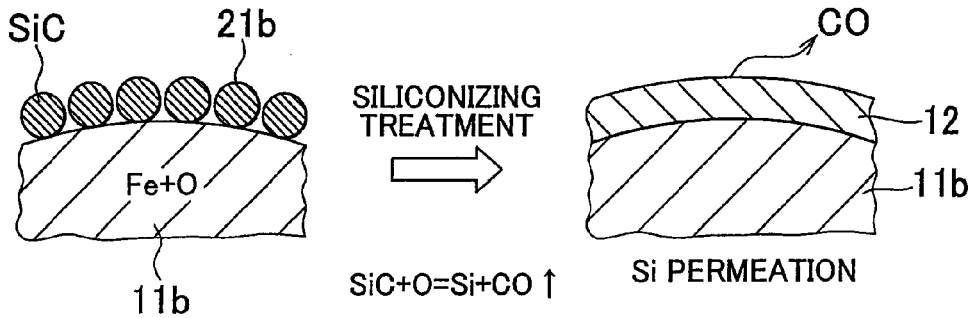

Several embodiments of the invention will be described below with reference to the appended drawings. FIG. 1 illustrates a method for advantageously manufacturing the powder for a magnetic core in accordance with the invention. FIGS. 2A and 2B illustrate a method for manufacturing a powder for a magnetic core of the first embodiment. FIG. 2A illustrates a siliconizing treatment using silicon dioxide ($SiO_2$) as a powder for siliconizing. FIG. 2B illustrates a siliconizing treatment using silicon carbide (SiC) as a powder for siliconizing. The below-described several embodiments differ in the methods for implementing the siliconizing treatment.

As shown in FIG. 1, the method for manufacturing a powder for a magnetic core of the first embodiment includes a process of performing a siliconizing treatment on the surface of an iron-based soft magnetic powder (iron powder) 11 and a process of performing a gradual oxidation treatment of the iron powder 11 subjected to the siliconizing treatment.

The siliconizing treatment of the first embodiment is a method in which elemental carbon or elemental oxygen contained in the soft magnetic powder is used, an oxidation-reduction reaction of the soft magnetic powder and powder for siliconizing is induced by heating the powder for siliconizing, and elemental silicon is caused to permeate and diffuse (solid solution diffusion) into the soft magnetic powder. First, as shown in FIG. 2A, a powder 21*a* of silicon dioxide ($SiO_2$) is brought into contact as a silicon compound under vacuum conditions with the surface of an iron powder 11*a* containing elemental carbon (C), and heating is performed at a temperature equal to or lower than 1180° C. More specifically, the iron powder 11*a* and the silicon dioxide powder 21*a* are brought into contact with each other by mixing, the mixture is placed into a furnace having a sealed space that can be evacuated, and the powders 11*a*, 21*a* are heated under the aforementioned temperature conditions. As a result, an oxidation-reduction reaction is induced between the silicon dioxide ($SiO_2$) and elemental carbon, as shown by a chemical reaction formula in FIG. 2A, elemental silicon (Si) is detached (generated) from the silicon dioxide ($SiO_2$), and carbon monoxide (CO) gas is generated. As a result, the detached elemental silicon permeates from the surface of the iron-based powder and diffuses (mainly diffuses in the surface layer) inside the iron powder 11*a*, thereby forming a silicon-permeated layer 12 into which the elemental silicon has permeated.

On the other hand, the elemental carbon contained in the surface of the iron-based powder becomes a carbon monoxide gas and at least the surface layer of the iron powder is decarburized. Due to the decrease in the content of carbon (C) in the iron powder surface, the elemental carbon contained inside the iron-based powder diffuses to the surface, and the diffused carbon also becomes a carbon monoxide gas by the aforementioned reaction. As a result, when elemental carbon is contained as an impurity in the soft magnetic powder, the content of the elemental carbon can be reduced and the degree of purification of the iron-based powder can be increased. Further, where the content of elemental carbon is adjusted, for example, by carburizing the soft magnetic powder, the amount of elemental silicon can be adjusted by a combination of this adjustment with the aforementioned reaction. Moreover, it is preferred that the oxidation-reduction reaction be conducted under temperature conditions at which an annealing treatment of the iron powder 11*a* is possible because the crystal grain size of the iron powder 11*a* can be increased and hysteresis loss can be reduced.

The gradual oxidation treatment is then performed in the above-described manner on the soft magnetic powder 11*a* subjected to the siliconizing treatment (see FIG. 1). In the gradual oxidation treatment, the soft magnetic powder subjected to the siliconizing treatment is placed under an inactive gas atmosphere with a controlled dew point and heated under this atmosphere, thereby making it possible to oxidize only elemental silicon, without oxidizing the elemental iron. As a result, a layer 13 including silicon dioxide ($SiO_2$) is further formed, so as to surround the silicon-permeated layer 12, thereby forming a silicon-containing layer 14 of the powder 10 for a magnetic core. By using the powder 10 for a magnetic core manufactured in the above-described manner, it is possible to form a compact layer 13 including silicon dioxide ($SiO_2$) and to manufacture a dust core with a high density.

As a modification example of the first embodiment, in the siliconizing treatment, an iron powder 11*b* containing elemental oxygen (O) and a silicon carbide (SiC) powder 21*b* are mixed, thereby bringing the silicon carbide powder as a silicon compound into contact with the iron powder surface under a vacuum atmosphere, as shown in FIG. 2B. The mixed powder may be then heated at a temperature equal to or lower than 1180° C. to induce the oxidation-reduction reaction of the silicon carbide (SiC) and elemental oxygen, as shown by a chemical reaction formula in FIG. 2B. As a result, elemental silicon (Si) is detached (generated) from the silicon carbide (SiC) and a carbon monoxide gas is generated. The detached elemental silicon then permeates from the iron-based powder surface and mainly diffuses into the surface layer of the iron powder 11*b*, thereby forming a silicon-permeated layer 12 into which elemental silicon has permeated.

Figure 3A:
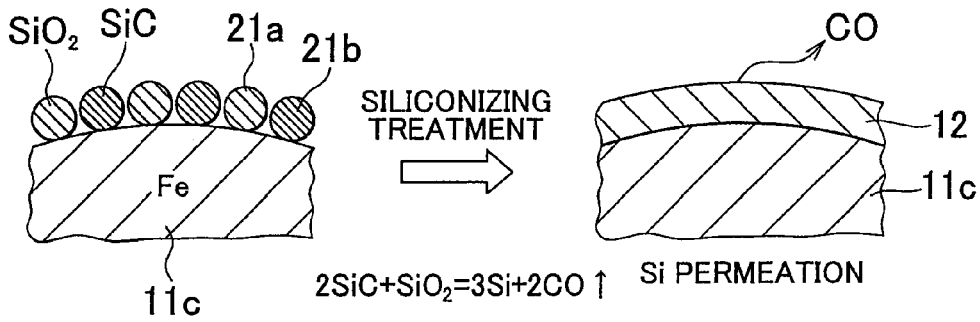
FIGS. 3A to 3C illustrate a second embodiment of the invention.
Figure 3B:
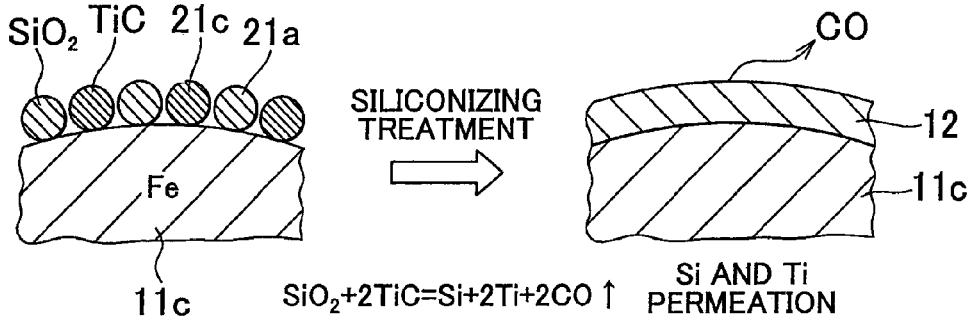
Figure 3C:
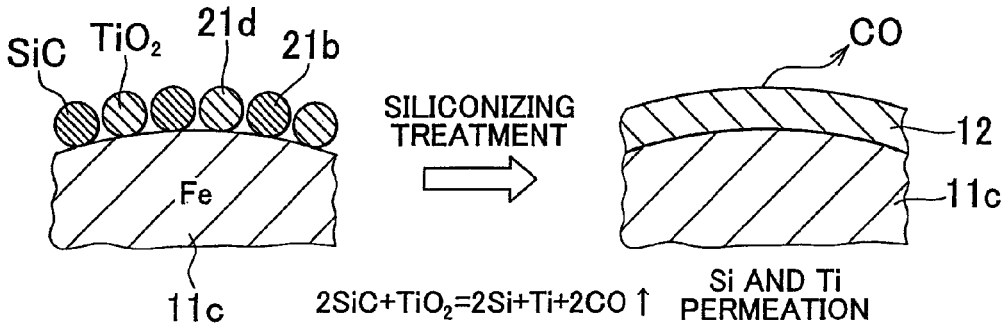

FIGS. 3A to 3C illustrate the second embodiment of the invention. FIG. 3A illustrates a siliconizing treatment using silicon dioxide ($SiO_2$) and silicon carbide (SiC) as powders for siliconizing. FIG. 3B illustrates a siliconizing treatment using silicon dioxide ($SiO_2$) as a powder for siliconizing and a powder of titanium carbide (TiC), as a modification example of the siliconizing treatment illustrated by FIG. 3A. FIG. 3C illustrates a siliconizing treatment using silicon carbide (SiC) as a powder for siliconizing and a powder of titanium oxide ($TiO_2$), as a modification example of the siliconizing treatment illustrated by FIG. 3A.

The second embodiment differs from the first embodiment in that in the siliconizing treatment of the second embodiment, an oxidation-reduction reaction of two or more dissimilar powders for siliconizing is induced by heating the powders for siliconizing and elemental silicon is caused to permeate and diffuse into an iron powder composed of pure iron.

In the present embodiment, powders 21*a*, 21*b* of silicon dioxide ($SiO_2$) and silicon carbide (SiC) as silicon compounds are brought into contact under a vacuum atmosphere with the surface of an iron powder 11*c* composed of pure iron, as shown in FIG. 3A, and heated under a temperature equal to or lower than 1180° C. More specifically, the iron powder 11*c*, silicon dioxide powder 21*a*, and silicon carbide powder 21*b* are brought into contact with each other by mixing, the mixture is placed into a furnace having a sealed space that can be evacuated, while maintaining the mixed state, and the powders 11*c*, 21*a*, 21*b* are heated under the aforementioned temperature conditions. An oxidation-reduction reaction is thus induced between the silicon dioxide ($SiO_2$) and silicon carbide (SiC), as shown by a chemical reaction formula in FIG. 3A, elemental silicon (Si) is detached (generated) from the silicon dioxide ($SiO_2$) and silicon carbide (SiC), and carbon monoxide (CO) gas is generated.

As a result, the detached elemental silicon permeates from the surface of the iron-based powder and mainly diffuses into the surface layer of the iron powder 11*c*, thereby forming a silicon-permeated layer 12 into which the elemental silicon has permeated. Further, in the present embodiment, by adjusting the amount of powder containing silicon dioxide ($SiO_2$) and the amount of silicon carbide powder, it is possible to adjust easily the amount of elemental silicon permeating into the iron powder, regardless of the content of carbon (C) and content of oxygen (O) in the iron powder.

As a modification example of the second embodiment, in the siliconizing treatment, a pure iron powder 11*c*, a powder 21*a* of silicon dioxide ($SiO_2$), and a powder 21*c* of titanium carbide (TiC) are mixed, thereby bringing the silicon dioxide powder 21*a* as a silicon compound and the titanium carbide powder 21*c* into contact with the iron powder surface under a vacuum atmosphere, as shown in FIG. 3B. The mixed powder may be then heated at a temperature equal to or lower than 1180° C. to induce the oxidation-reduction reaction of the silicon dioxide ($SiO_2$) and titanium carbide (TiC), as shown by a chemical reaction formula in FIG. 3B.

As a result, elemental silicon (Si) is detached (generated) from the silicon dioxide ($SiO_2$) and a carbon monoxide gas is generated. The detached elemental silicon then permeates from the iron-based powder surface and mainly diffuses into the surface layer of the iron powder 11*c*, thereby forming a silicon-permeated layer 12 into which elemental silicon has permeated. Further, in the present modification example, by adjusting the amount of silicon dioxide powder 21*a* and the amount of titanium carbide powder 21*c*, it is possible to adjust easily the amount of elemental silicon permeating into the iron powder, regardless of the content of carbon (C) and content of oxygen (O) in the iron powder. Because the titanium carbide powder 21*c* is used, elemental titanium is also detached from titanium carbide (TiC). Therefore, the elemental titanium can be also caused to permeate into the soft magnetic powder.

As another modification example, in the siliconizing treatment, a pure iron powder 11*c*, a powder 21*b* of silicon carbide (SiC), and a powder 21*d* of titanium oxide ($TiO_2$) are mixed, thereby bringing the silicon carbide powder 21*b* as a silicon compound and the titanium oxide ($TiO_2$) powder 21*d* into contact with the iron powder surface under a vacuum atmosphere, as shown in FIG. 3C. The mixed powder may be then heated at a temperature equal to or lower than 1180° C. to induce the oxidation-reduction reaction of the silicon carbide (SiC) and titanium oxide ($TiO_2$), as shown by a chemical reaction formula in FIG. 3C.

As a result, elemental silicon permeates from the iron-based powder surface and mainly diffuses into the surface layer of the iron powder 11*c*, thereby forming a silicon-permeated layer 12 into which elemental silicon has permeated. Further, in the present modification example, the amount of elemental silicon permeating into the iron powder can be adjusted in the same manner as in the modification example shown in FIG. 3B. At the same time, because the titanium oxide powder 21*d* is used, elemental titanium is also detached from titanium oxide ($TiO_2$). Therefore, the elemental titanium can be also caused to permeate into the soft magnetic powder.

In the second embodiment, the iron powder 11*c* is mixed together with powders for siliconizing of different kinds, but it is also possible to mix the powders for siliconizing of different types in advance, thereby obtaining a mixed powder, and then mix the mixed powder with the iron powder 11*c*.

Figure 4A:
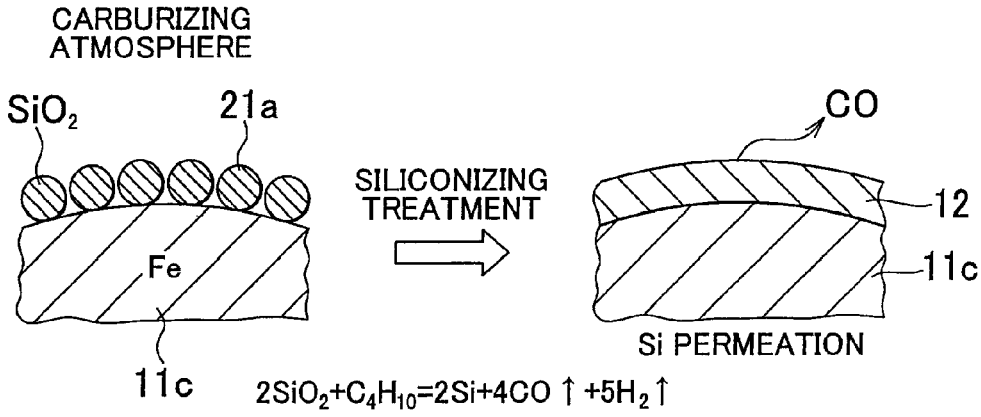
FIGS. 4A and 4B illustrate a third embodiment of the invention.
Figure 4B:
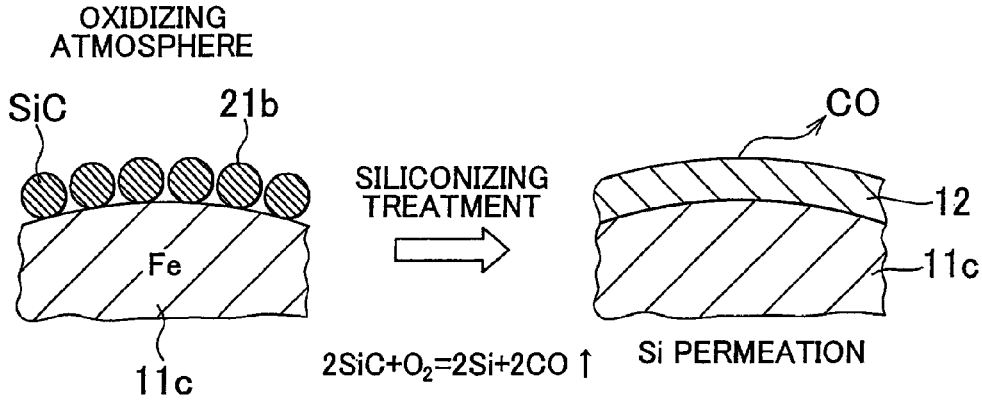

FIGS. 4A and 4B illustrate the third embodiment of the invention. FIG. 4A illustrates a siliconizing treatment using silicon dioxide ($SiO_2$) as a powder for siliconizing. FIG. 4B illustrates a siliconizing treatment using silicon carbide (SiC) as a powder for siliconizing, as a modification example of the siliconizing treatment illustrated by FIG. 4A.

The third embodiment differs from the first embodiment in that in the siliconizing treatment of the third embodiment, a treatment gas is caused to flow at a contact surface of a pure iron powder and a powder for siliconizing, an oxidation-reduction reaction of the treatment gas and the powder for siliconizing is induced, and the elemental silicon is caused to permeate and diffuse into the iron powder.

In the present embodiment, as shown in FIG. 4A, silicon dioxide ($SiO_2$) as a silicon compound is brought into contact with the surface of a pure iron powder 11*c* under an atmosphere of butane gas as a hydrocarbon gas, and heating is performed at a temperature equal to or lower than 1180° C. More specifically, the iron powder 11*c* and silicon dioxide powder 21*a* are brought into contact with each other by mixing, the powders are placed into a carburizing furnace into which a butane gas can be supplied and from which the butane gas can be discharged, while maintaining the mixed state of the powders, and the powders 11*c*, 21*a* are heated under the aforementioned temperature conditions, while supplying the butane gas into the furnace. As a result, an oxidation-reduction reaction of the silicon dioxide ($SiO_2$) and butane gas is generated, as shown by the chemical reaction formula in FIG. 4A, elemental silicon (Si) is detached (generated) from the silicon dioxide ($SiO_2$), and a carbon monoxide (CO) gas and a hydrogen ($H_2$) gas are also generated.

As a result, the detached elemental silicon permeates from the iron-based powder surface and mainly diffuses into the surface layer of the iron powder 11*c*, thereby forming a silicon-permeated layer 12 into which elemental silicon has permeated. Further, in the present embodiment, the amount of elemental silicon permeating into the iron powder can be easily adjusted by adjusting the amount of powder containing silicon dioxide ($SiO_2$), regardless of the carbon content and oxygen content in the iron powder.

As a modification example of the third embodiment, in the siliconizing treatment, a pure iron powder 11*c* and a powder 21*b* of silicon carbide (SiC) are mixed and brought into contact with each other under an oxidizing atmosphere using an ammonia decomposition gas (ammonia decomposition gas with a high dew point) including water vapor, as shown in FIG. 4B. The mixed powder may be then placed in a furnace and heated at a temperature equal to or layer than 1180° C. to induce the oxidation-reduction reaction of the silicon carbide (SiC) and elemental oxygen, as shown by a chemical reaction formula in FIG. 4B. As a result, the detached elemental silicon permeates from the iron-based powder surface and mainly diffuses into the surface layer of the iron powder 11*c*, thereby forming a silicon-permeated layer 12 into which elemental silicon has permeated.

Figure 5:
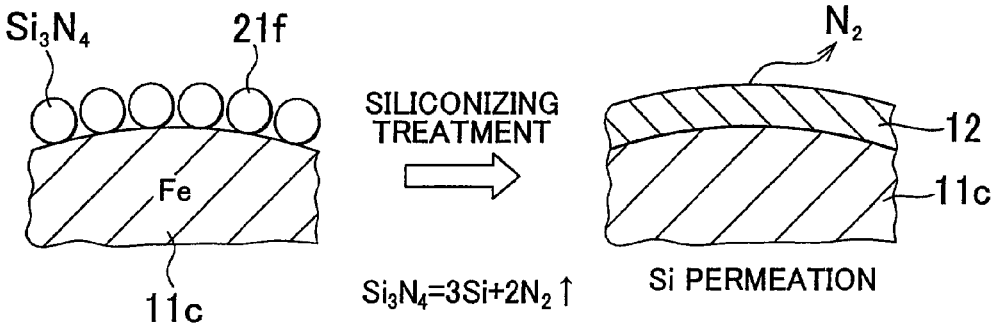
FIG. 5 illustrates a fourth embodiment of the invention.

FIG. 5 illustrates the fourth embodiment of the invention. The fourth embodiment differs from the first embodiment in that in the siliconizing treatment of the fourth embodiment, a self-decomposition reaction of a silicon compound of the powder for siliconizing is induced by heating the powder for siliconizing, and the elemental silicon is caused to permeate and diffuse into the iron powder.

In the present embodiment, as shown in FIG. 5, silicon nitride ($Si_3N_4$) is used as a silicon compound, brought into contact with the surface of an iron powder 11*c* under an atmosphere with a pressure equal to or lower than the atmospheric pressure, and heated at a temperature equal to or lower than 1180° C. More specifically, the iron powder 11*c* and a silicon nitride powder 21*f* are brought into contact with each other by mixing, the powders are placed in a furnace, while maintaining the mixed state thereof, and then the powders 11*c*, 21*f* are heated under the aforementioned temperature conditions. As a result, a decomposition reaction of silicon nitride ($Si_3N_4$) is induced as shown by a chemical reaction formula in FIG. 5, elemental silicon (Si) is detached from silicon nitride ($Si_3N_4$), and a nitrogen gas ($N_2$) is generated.

As a result, the detached elemental silicon permeates from the iron-based powder surface and mainly diffuses into the surface layer of the iron powder 11*c*, thereby forming a silicon-permeated layer 12 into which elemental silicon has permeated. Further, in the present embodiment, the amount of elemental silicon permeating into the iron powder can be easily adjusted by adjusting the amount of silicon nitride powder, regardless of the content of carbon (C) and content of oxygen (O) in the iron powder. The present embodiment can be also carried out by combining the first embodiment and the second embodiment.

The first embodiment and fourth embodiment will be explained below based on examples thereof.

EXAMPLE 1

Figure 6A:
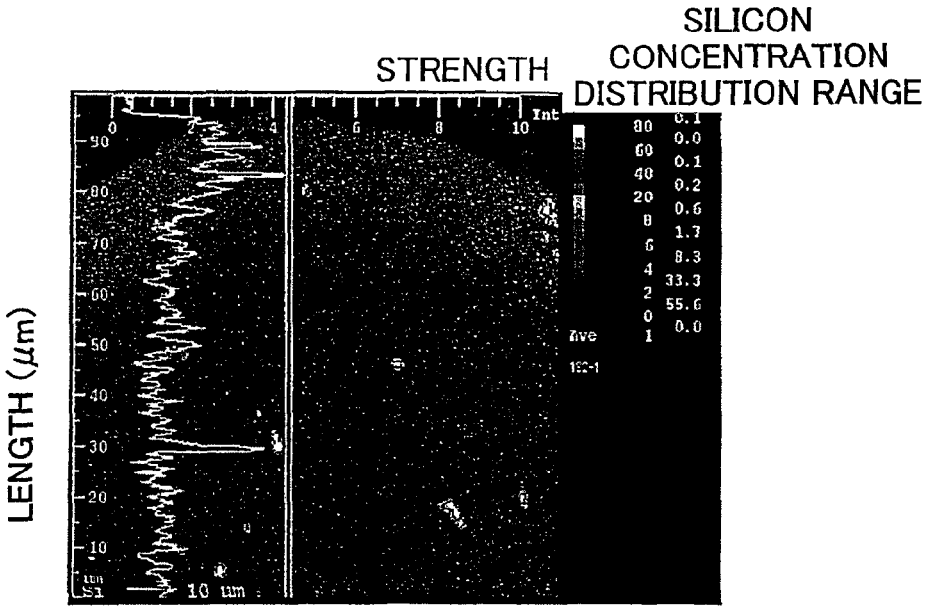
FIGS. 6A and 6B are photos of electron probe micro analyzer (EPMA) images illustrating the cross section of the powder for a magnetic core and results obtained in measuring the amount of elemental silicon that has permeated into the powder for a magnetic core from the surface thereof.

An iron powder manufactured by gas atomization and having a composition of Fe-0.51% C was prepared as a soft magnetic powder. Then, test sieving was used according to JIS-Z8801 to obtain a mean particle size of the iron powder of 180 μm. A silicon dioxide powder with a mean particle size of 1 μm was prepared as powder for siliconizing. The silicon dioxide powder was added to the iron powder and mixed therewith to bring the silicon dioxide powder into contact with the iron powder surface, the powders were loaded into a furnace and heated under vacuum (more specifically, under a pressure of about $1\times10^{-3}$ Pa) for 4 h at a temperature of 1100° C. to fabricate a powder for a magnetic core. The variation of content (ppm by weight) of carbon (C) in the iron powder with the passage of time was measured, the soft magnetic powder was cut, and the content of elemental silicon was observed and analyzed by EPMA and SEM-EDX. The results are shown in Table 1, Table 2, and FIG. 6A. In FIG. 6A, the closer is the color to white, the higher is the content of elemental silicon.

TABLE 1

| | Example 1 | Example 2 | Example 3 | Example 4 | Example 5 | Comparative Example 1 |
|---|---|---|---|---|---|---|
| Powder for siliconizing | Silicon dioxide | Silicon dioxide | Silicon dioxide | Silicon carbide | Silicon nitride | — |
| Particle size of powder | 1 μm | 50 nm | 50 nm | 610 nm | 750 nm | — |
| Treatment temperature | 1100 | 1100 | 1100 | 1100 | 1180 | 850 |
| Treatment time (h) | 4 | 4 | 1 | 4 | 10 | 0.5 |
| Surface Si concentration (%) | 0.3 | 1.0 | 3.0 | 0.3 | 2.8 | 0.3 |

TABLE 2

| | $SiO_2$ particle size | Before treatment | In 15 min | In 30 min | In 60 min | In 120 min | In 240 min |
|---|---|---|---|---|---|---|---|
| Example 1 | 1 μm | 5100 ppm | 3900 ppm | 3000 ppm | 2200 ppm | 680 ppm | <30 ppm |
| Example 2 | 50 nm | 5100 ppm | <30 ppm | <30 ppm | <30 ppm | <30 ppm | <30 ppm |

EXAMPLE 2

Figure 6B:
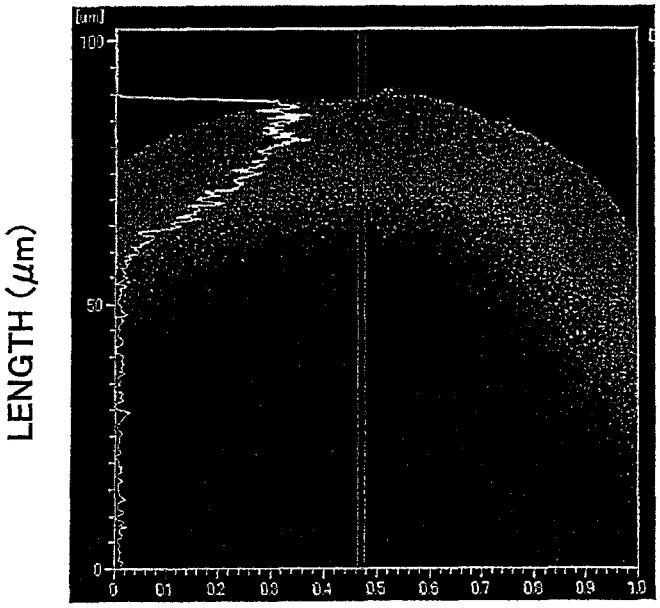

An iron powder was prepared in the same manner as in Example 1 and a powder for a magnetic core was fabricated. In Example 2, the particle size of the powder for siliconizing was changed with respect to that of Example 1. The variation of content (ppm by weight) of carbon (C) in the iron powder with the passage of time was measured and the content of elemental silicon after the heat treatment was measured with respect to the soft magnetic powder of Example 2 in the same manner as in Example 1. The results are shown in Table 1 and Table 2. The concentration of elemental silicon was analyzed by EPMA in the same manner. The results are shown in FIG. 6B.

EXAMPLE 3

An iron powder and a silicon dioxide powder were prepared in the same manner as in Example 2 and a powder for a magnetic core was fabricated. In Example 3, the siliconizing treatment pattern was changed with respect to that of Example 2. The content of elemental silicon was measured in the same manner as in Example 1. The results are shown in Table 1.

EXAMPLE 4

An iron powder manufactured by gas atomization, having a mean particle size of 180 μm and containing 0.294 wt. % elemental oxygen was prepared as a soft magnetic powder. A powder of silicon carbide (SiC) with a mean particle size of 610 nm was prepared as a powder for siliconizing. The silicon carbide powder was added and mixed so as to bring it into contact with the iron powder surface, the powders were loaded into a furnace, and heating was performed for 4 h at a temperature of 1100° C. under vacuum to fabricate a powder for a magnetic core. The content of elemental silicon after the heat treatment was measured. The results are shown in Table 1.

EXAMPLE 5

An iron powder manufactured by gas atomization, having a mean particle size of 180 μm and consisting of pure iron (Fe-0.02% C) was prepared as a soft magnetic powder. A powder of silicon nitride ($Si_3N_4$) with a mean particle size of 750 nm was prepared as a powder for siliconizing. The silicon nitride powder was added to the iron powder and mixed so as to bring the silicon nitride powder into contact with the iron powder surface, the powders were loaded into a furnace, and heating was performed for 10 h at a temperature of 1180° C. under vacuum to fabricate a powder for a magnetic core. The content of elemental silicon after the heat treatment was measured. The results are shown in Table 1.

Comparative Example 1

A soft magnetic powder was prepared in the same manner as in Example 1. The surface of the soft magnetic powder was subjected to a siliconizing treatment by a CVD method. More specifically, argon gas and silicon tetrachloride gas as a treatment gas were caused to flow to the soft magnetic powder and a siliconizing treatment of the soft magnetic powder surface was carried out for 0.1 h at a treatment temperature of 850° C. The content of elemental silicon after the heat treatment was measured. The results are shown in Table 1.

(Result 1) As shown in Table 1, the concentration of elemental silicon in the surface of powder for a magnetic core was the same in Examples 1, 4 and Comparative Example 1. Further, the concentration of elemental silicon in the surface of the powder of Examples 2, 3, and 5 was higher than that of Comparative Example 1. According to the SEM-EDX results, in Examples 1 to 5, elemental silicon could be confirmed to permeate from the surface of the soft magnetic powder and diffuse in the surface layer thereof. The concentration of elemental silicon decreased gradually from the surface inwardly (the concentration of elemental silicon increased gradually from the inside toward the surface).

(Result 2) As shown in Table 1, even when the treatment time was the same, the concentration of elemental silicon in the surface of the powder for a magnetic core of Example 2 was higher than that of Example 1. Further, as shown in Table 2, the amount of carbon (C) in the soft magnetic material of Example 2 decreased to 30 ppm by weight or less within 15 min after the treatment, and the amount of carbon (C) in the soft magnetic material of Example 1 decreased to 30 ppm by weight or less within 4 h.

(Result 3) As shown in FIGS. 6A and 6B, the diffusion of elemental silicon into the iron powder of Example 1 and Example 2 could be confirmed and the increase in concentration of elemental silicon in the surface layer including the surface of the iron powder could be also confirmed. Further, the enrichment with elemental silicon could be confirmed to be higher in Example 2 than in Example 1.

(Consideration 1) The Result 1 suggests that because elemental silicon was observed and carbon content decreased in the surface of the powders for a magnetic core of Examples 1 to 3, a reaction proceeded between silicon dioxide ($SiO_2$) of the powder for siliconizing and carbon (C) contained in the soft magnetic material and the reaction produced elemental silicon and carbon monoxide gas. This is apparently why the powder for a magnetic core was siliconized and the decrease in the amount of elemental carbon increased the purity of the soft magnetic material.

In Example 4, elemental silicon was similarly generated from silicon carbide (SiC) by the oxidation-reduction reaction. In Example 5, elemental silicon was generated from silicon nitride ($Si_3N_4$) by decomposition of silicon nitride ($Si_3N_4$). The elemental silicon thus generated permeated and diffused into the soft magnetic material. Thus, the features discussed in the above-described second embodiment and third embodiment may be employed, provided that elemental silicon is generated and the generated elemental silicon permeates (forms solid solution) from the surface of the soft magnetic material and diffuses at least in the surface layer of the soft magnetic material.

(Consideration 2) The Results 2, 3 demonstrate that the number of contact points of the powder for siliconizing with the surface of soft magnetic material increases with the decrease in the size of powder for siliconizing, as in Example 2. Therefore, the reaction is enhanced and the permeation of the elemental silicon into the soft magnetic material is also enhanced. By using a powder for siliconizing with the above-described mean particle size, it is possible to detach (generate) elemental silicon with higher efficiency. The results obtained in Examples 1 and 2 demonstrate that in order to induce the detachment (generation) of elemental silicon with better efficiency, it is preferred that the mean particle size of the powder for siliconizing be smaller, and a mean particle size of about several tens of nanometers is more preferred. However, with consideration for production cost and handleability of the powder, it is preferred that the powder have a mean particle size of 20 nm or more.

EXAMPLE 6

Figure 7:
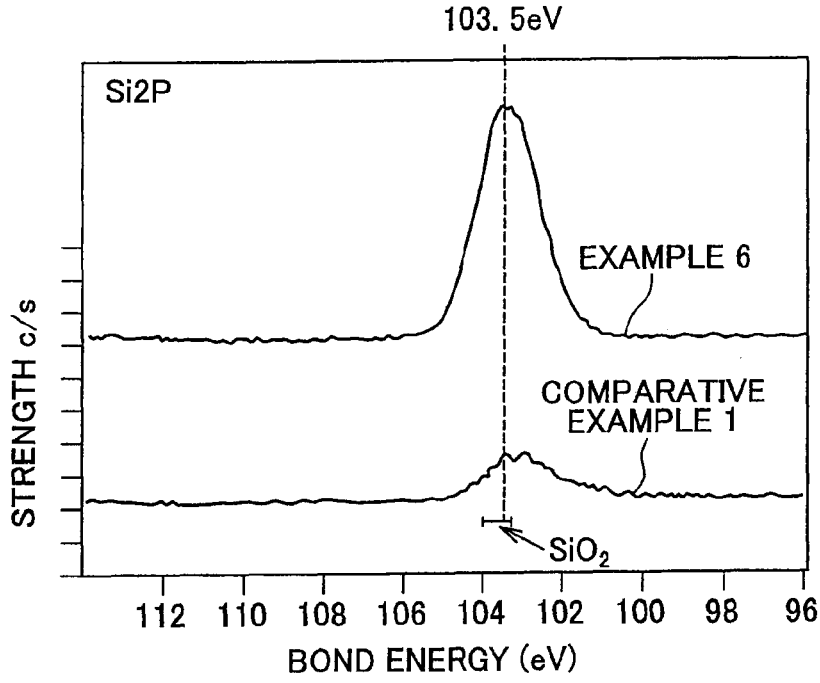
FIG. 7 shows the results obtained in analyzing the intensity of silicon dioxide ($SiO_2$) on the surface of the powder for a magnetic core of Example 6 and Comparative Example 1.
Figure 8:
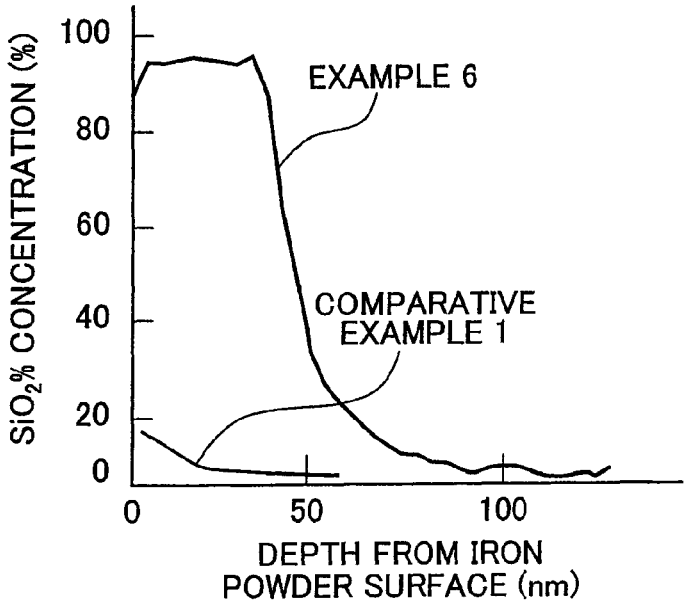
FIG. 8 shows the results obtained in analyzing the concentration distribution of silicon dioxide ($SiO_2$) from the surface to the inner zone of the powder for a magnetic core of Example 6 and Comparative Example 1.

A powder for a magnetic core was produced in the same manner as in Example 3, and the soft magnetic material after the siliconizing treatment was subjected to a gradual oxidation treatment under an atmosphere including hydrogen gas, argon gas, and water vapor in a very small amount by comparison with that of hydrogen ($H_2$) and argon. The peak intensity of silicon dioxide ($SiO_2$) on the surface was then measured by X-ray photoelectron spectroscopy (XPS) and the concentration of silicon dioxide ($SiO_2$) was measured from the surface inwardly. The results are shown in FIGS. 7 and 8. Identical measurements were also performed with respect to Comparative Example 1. The results are also shown in FIGS. 7 and 8.

(Results 4) As shown in FIG. 7, in Example 6, a high intensity was obtained in a location of a bond energy corresponding to silicon dioxide ($SiO_2$). The intensity at this location in Comparative Example 1 was low. As shown in FIG. 8, it was observed that the silicon dioxide layer of Example 6 was formed to a depth of about 100 nm from the surface.

(Observation 3) The Result 4 indicates that in Example 6 an elemental silicon generation reaction proceeded at the surface of the soft magnetic material. Therefore, by contrast with Comparative Example 1 in which the reaction of silicon tetrachloride is induced by CVD, no compounds of elemental silicon and elemental iron are generated and the amount of elemental silicon permeated and diffused into the soft magnetic material is higher than that of Comparative Example 1. This is apparently why a layer including dense silicon dioxide was formed in the powder for a magnetic core of Example 6.

EXAMPLE 7

A powder for a magnetic core was produced in the same manner as in Example 2, and the soft magnetic material after the siliconizing treatment was subjected to a gradual oxidation treatment under an atmosphere including hydrogen gas, argon gas, and water vapor in a very small amount by comparison with that of hydrogen and argon. The fabricated powder for a magnetic core was molded into a ring-shaped sample with an outer diameter of 39 mm, an inner diameter of 30 mm, and a thickness of 5 mm by using a warm die lubrication method at a die temperature of 120° C. and under a molding surface pressure of 1569 MPa, and magnetic properties of the sample were evaluated. The results are shown in Table 3.

TABLE 3

| | Example 7 | Example 8 | Comparative Example 2 | Comparative Example 3 |
|---|---|---|---|---|
| Eddy current loss (W/kg) | 40 | 15 | 980 | 62 |
| Magnetic flux density (T/B50) | 1.7 | 1.5 | 1.7 | 1.3 |

EXAMPLE 8

A powder for a magnetic core was produced in the same manner as in Example 3. Then, the gradual oxidation treatment and molding were performed in the same manner as in Example 7 and a ring-shaped sample was produced. Magnetic properties of the sample were evaluated. The results are shown in Table 3.

COMPARATIVE EXAMPLE 2

A powder for a magnetic core was produced in the same manner as in Comparative Example 1. Then, a ring-shaped sample was produced under the same conditions as in Example 7. Magnetic properties of the sample were evaluated. The results are shown in Table 3.

COMPARATIVE EXAMPLE 3

A powder for a magnetic core was produced in the same manner as in Comparative Example 1, and a silicone resin was added to the surface of the powder for a magnetic core at a ratio of 0.4%. Then, a dust core was produced under the same conditions as in Example 7. Magnetic properties of the core were evaluated. The results are shown in Table 3.

(Result 5) In Examples 7, 8, the eddy current loss decreased significantly with respect to that of Comparative Examples 2, 3. In particular, in example 7, the magnetic flux density identical to that of Comparative Example 3 was obtained.

(Consideration 4) According to the above-described Result 4 and Result 5, good magnetic properties of Examples 7, 8 are apparently due to the formation of a thin and dense silicon dioxide layer on the soft magnetic material surface, by contrast with Comparative Examples 2, 3.

Several embodiments of the method for manufacturing a powder for a magnetic core in accordance with the invention are described above, but the invention is not limited to these embodiments, and a variety of modifications can be made without departing from the spirit of the invention described in the appended claims.

For example, in the first, second, and fourth embodiments, the siliconizing treatment was performed under vacuum atmosphere to enhance the detachment (generation) of elemental silicon, but the siliconizing treatment is not limited to the vacuum environment and may be conducted under a low-pressure atmosphere, or an atmosphere with a low partial pressure of the generated gas, more specifically an atmosphere with a low concentration of carbon monoxide (CO), or an atmosphere with a low concentration of nitrogen ($N_2$).

Further, in all the embodiments, an iron powder is used as a soft magnetic material, but a dust core can be also produced by using a Fe—Si alloy, a Fe—Al alloy, or a Fe—Si—Al alloy, and any soft magnetic material may be used provided that the elemental silicon or a metal element (more specifically, Ti, Al, or the like) that is generated simultaneously with the elemental silicon in accordance with the invention can be caused to permeate. Also, respective embodiments can be employed in combination.

Further, a dust core may be also molded by additionally forming a coating film of an insulating material such as a silicone resin on the surface of the powder for a magnetic core of the embodiments.

The powder for a magnetic core in accordance with the invention is suitable for iron cores of electric motors and power generators, solenoids for electromagnetic valves, core parts for actuators of various types, and the like.

The invention claimed is:

1. A method for manufacturing a powder for a magnetic core comprising:

a siliconizing treatment process of performing a siliconizing treatment on a surface of a soft magnetic powder that includes:

bringing a powder for siliconizing that contains at least a silicon compound into contact with the surface of the soft magnetic powder;

detaching elemental silicon from the silicon compound by heating the powder for siliconizing; and performing the siliconizing treatment by causing the detached elemental silicon to permeate and diffuse into a surface layer of the soft magnetic powder;

and the method further comprising a process of performing a gradual oxidizing treatment on the soft magnetic powder after the siliconizing treatment, wherein the powder used for siliconizing is one of a first mixed powder obtained by mixing at least the powder of silicon dioxide and the powder of silicon carbide, a second mixed powder obtained by mixing the powder containing at least silicon dioxide and a powder containing either or both of a metal carbide and a carbon allotrope, and a third mixed powder obtained by mixing the powder containing at least silicon carbide and a powder of at least one kind from among powders composed of metal oxides.

2. The method for manufacturing a powder for a magnetic core according to claim 1, wherein the gradual oxidizing treatment is performed by heating the soft magnetic powder after the siliconizing treatment under an oxygen atmosphere with an oxygen concentration (partial pressure of oxygen) lower than the air atmosphere.

3. The method for manufacturing a powder for a magnetic core according to claim 2, wherein the gradual oxidizing treatment is performed by heating the soft magnetic powder after the siliconizing treatment under an atmosphere comprising an inactive gas and water vapor.

4. The method for manufacturing a powder for a magnetic core according to claim 1, wherein a powder for siliconizing that has a mean particle size within a range of equal to or less than 1 μm is used as the powder for siliconizing.

5. The method for manufacturing a powder for a magnetic core according to claim 1, wherein a powder for siliconizing that has a mean particle size within a range of equal to or less than 1 μm and equal or more than 20 nm is used as the powder for siliconizing.

6. The method for manufacturing a powder for a magnetic core according to claim 1, wherein an iron-based powder is used as the soft magnetic powder, and the siliconizing treatment is performed together with an annealing treatment of the magnetic powder.

7. The method for manufacturing a powder for a magnetic core according to claim 1, wherein an iron-based powder containing at least carbon is used as the soft magnetic powder; and a powder containing at least silicon dioxide is used as the powder for siliconizing.

8. The method for manufacturing a powder for a magnetic core according to claim 1, wherein an iron-based powder containing at least oxygen is used as the soft magnetic powder; and a powder containing at least silicon carbide is used as the powder for siliconizing.

9. The method for manufacturing a powder for a magnetic core according to claim 8, wherein the siliconizing treatment is performed under a vacuum atmosphere.

10. The method for manufacturing a powder for a magnetic core according to claim 1, wherein the powder containing at least silicon dioxide is used as the powder for siliconizing; and the siliconizing treatment is performed under a hydrocarbon gas atmosphere.

11. The method for manufacturing a powder for a magnetic core according to claim 1, wherein the powder containing at least silicon carbide is used as the powder for siliconizing; and the siliconizing treatment is performed under an oxidizing atmosphere.

12. The method for manufacturing a powder for a magnetic core according to claim 1, wherein a powder containing silicon nitride is used as the powder for siliconizing.

13. A method for manufacturing a powder for a magnetic core comprising:

a siliconizing treatment process of performing a siliconizing treatment on a surface of a soft magnetic powder that includes:

bringing a powder for siliconizing that contains at least a silicon compound into contact with the surface of the soft magnetic powder;

detaching elemental silicon from the silicon compound by heating the powder for siliconizing; and performing the siliconizing treatment by causing the detached elemental silicon to permeate and diffuse into a surface layer of the soft magnetic powder;

and the method further comprising a process of performing a gradual oxidizing treatment on the soft magnetic powder after the siliconizing treatment, wherein the powder used for siliconizing contains at least silicon dioxide, and wherein the siliconizing treatment is performed under a hydrocarbon gas atmosphere.

* * * * *

UNITED STATES PATENT AND TRADEMARK OFFICE

CERTIFICATE OF CORRECTION

PATENT NO. : 8,414,984 B2
APPLICATION NO. : 12/742507
DATED : April 9, 2013
INVENTOR(S) : Hoshina et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 209 days.

In the Specification:

In the section entitled Summary of the Invention, at column 6, line 41:
Delete "(sic)" and insert therefor --(SiC)--.

Signed and Sealed this
Thirteenth Day of August, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,414,984 B2
APPLICATION NO. : 12/742507
DATED : April 9, 2013
INVENTOR(S) : Hoshina et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 245 days.

Signed and Sealed this
First Day of September, 2015

Michelle K. Lee

Michelle K. Lee
*Director of the United States Patent and Trademark Office*